US010695685B2

(12) United States Patent
Balanchi

(10) Patent No.: US 10,695,685 B2
(45) Date of Patent: Jun. 30, 2020

(54) TOY SEGMENTED TUBE TRACK KIT

(71) Applicant: MINDSCOPE PRODUCTS, Glenvale, CA (US)

(72) Inventor: George Balanchi, Pasadena, MD (US)

(73) Assignee: MINDSCOPE PRODUCTS, Sonoma, CA (US)

( * ) Notice: Subject to any disclaimer, the term of this patent is extended or adjusted under 35 U.S.C. 154(b) by 0 days.

(21) Appl. No.: 16/350,298

(22) Filed: Oct. 30, 2018

(65) Prior Publication Data

US 2019/0336875 A1 Nov. 7, 2019

Related U.S. Application Data

(60) Provisional application No. 62/764,391, filed on Aug. 1, 2018, provisional application No. 62/762,411, filed on May 3, 2018.

(51) Int. Cl.

| | |
|---|---|
| ***A63H 18/02*** | (2006.01) |
| ***A63H 17/26*** | (2006.01) |
| ***A63H 31/00*** | (2006.01) |
| ***A63H 29/00*** | (2006.01) |
| *A63H 17/00* | (2006.01) |
| *A63H 29/18* | (2006.01) |
| *A63H 29/22* | (2006.01) |

(52) U.S. Cl.

CPC ..... *A63H 18/02* (2013.01); *A63H 17/262* (2013.01); *A63H 29/00* (2013.01); *A63H 31/00* (2013.01); *A63H 29/18* (2013.01); *A63H 29/22* (2013.01)

(58) Field of Classification Search

CPC ..... A63H 18/00; A63H 18/02; A63H 18/021; A63H 17/00; A63H 17/14; A63H 17/262; A63H 17/26

USPC ..... 446/431, 444–447, 465, 466, 469–471

See application file for complete search history.

(56) References Cited

U.S. PATENT DOCUMENTS

| | | | | |
|---|---|---|---|---|
| 3,475,023 | A * | 10/1969 | Fauvelle | A63B 5/20 482/82 |
| 5,507,679 | A * | 4/1996 | Getsay | A63H 18/00 104/119 |
| 2005/0266768 | A1* | 12/2005 | Bailey | A63H 17/14 446/427 |
| 2016/0220915 | A1* | 8/2016 | Cheung | A63H 18/02 18/2 |

* cited by examiner

*Primary Examiner* — Kien T Nguyen

(74) *Attorney, Agent, or Firm* — Jonathan E. Grant; Grant Patent Services

(57) ABSTRACT

A toy is disclosed for a segmented tube track kit. The toy comprises a tube, comprised of reversibly attachable tubes. In one embodiment, the tube segments are held together frictionally. In another embodiment, tube segments are held together by locking mechanisms consisting of projections and cutouts. The toy vehicle in the kit has a drive wheel which is forced up away from the body of the car and against the inner walls of the tube by resilient members. In another embodiment, the vehicle has a tumbler wheel at the front of the car.

9 Claims, 20 Drawing Sheets

TOY SEGMENTED TUBE TRACK KIT

This application claims priority to provisional applications 62/764,391 filed Aug. 1, 2018 and 62/762,411 filed May 3, 2018.

A toy tube track kit is taught wherein the tube is made up of a variety of segments, and which has a specially designed car to traverse the track.

BRIEF DESCRIPTION OF THE FIGURES

The figures depict various embodiments of the described methods and kit and are for purposes of illustration only. One skilled in the art will readily recognize from the following discussion that alternative embodiments of the methods and kits illustrated herein may be employed without departing from the principles of the methods and kits described herein.

DETAILED DESCRIPTION OF THE EMBODIMENT

Figure 1:
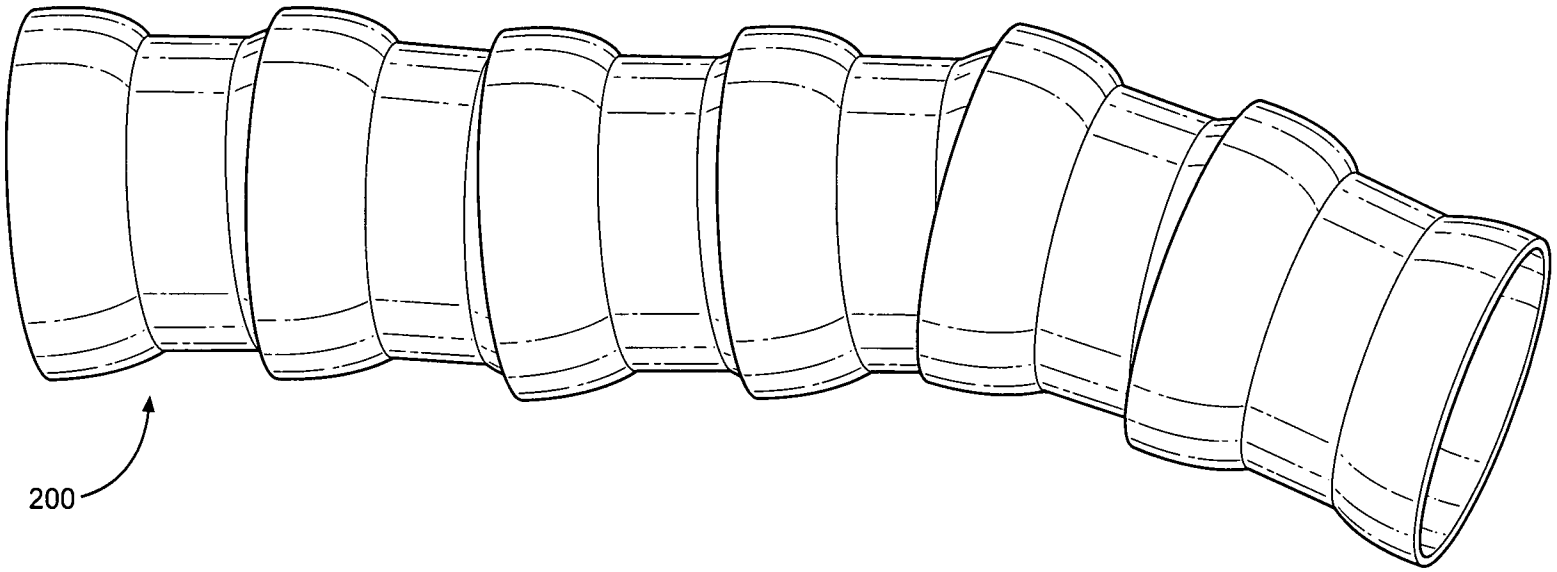
FIG. 1 is a perspective view of one embodiment of a segmented tube.
Figure 2:
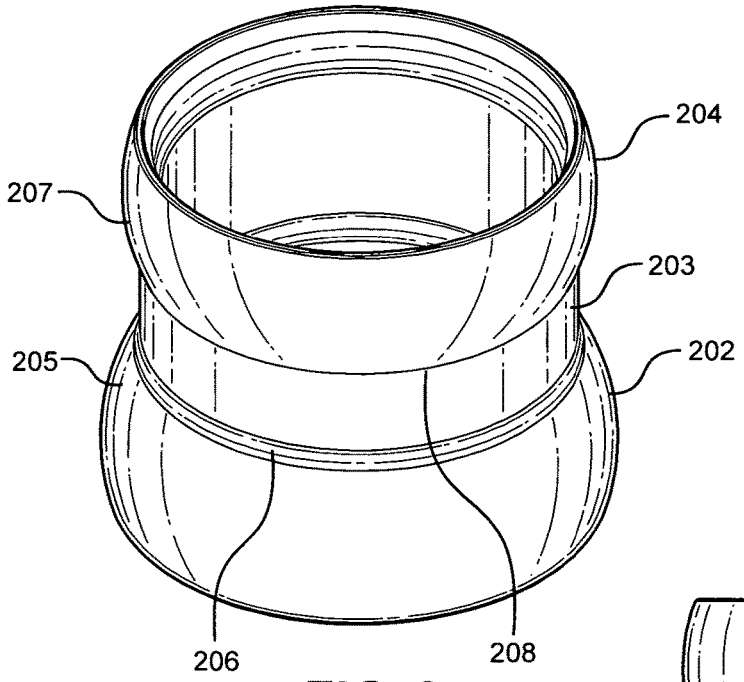
FIG. 2 is a perspective view of a segment from the segmented tube of FIG. 1.
Figure 3:
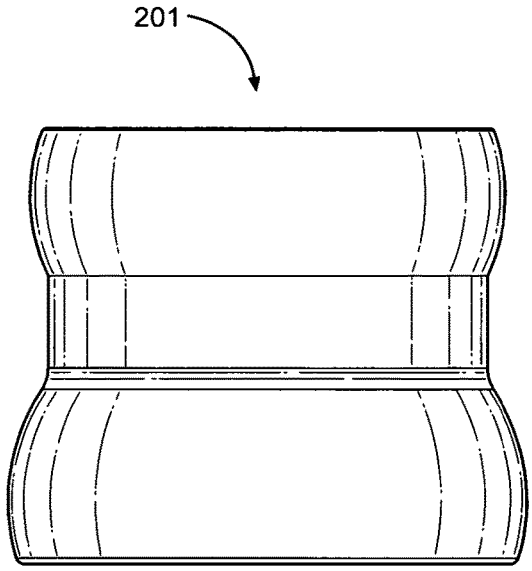
FIG. 3 is a side view of the segment from the segmented tube of FIG. 1.
Figure 4:
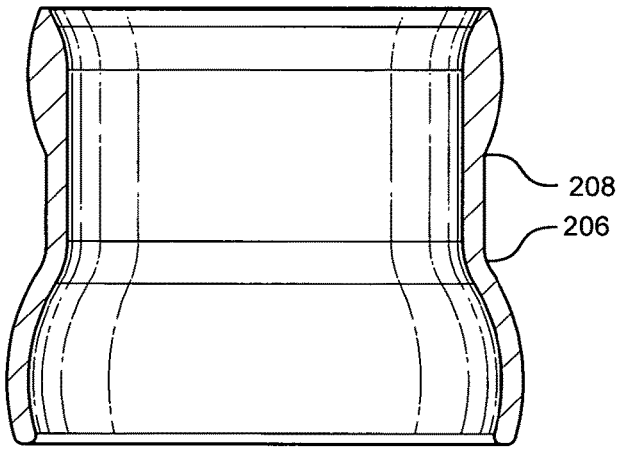
FIG. 4 is a cross-section of the segment of a segmented tube of FIG. 1.
Figure 5:
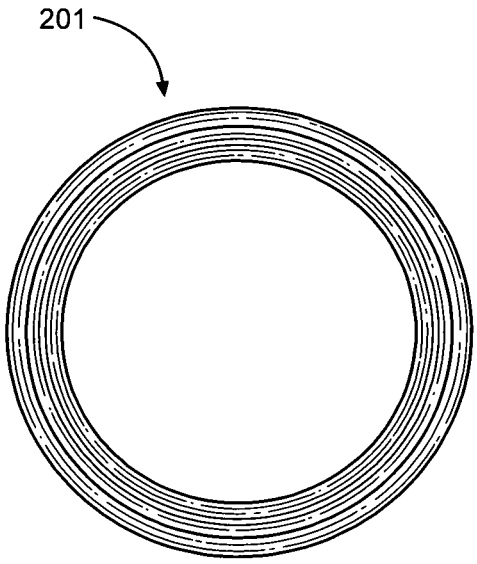
FIG. 5 is a top view of the top of the segment of the segmented tube of FIG. 1.
Figure 6:
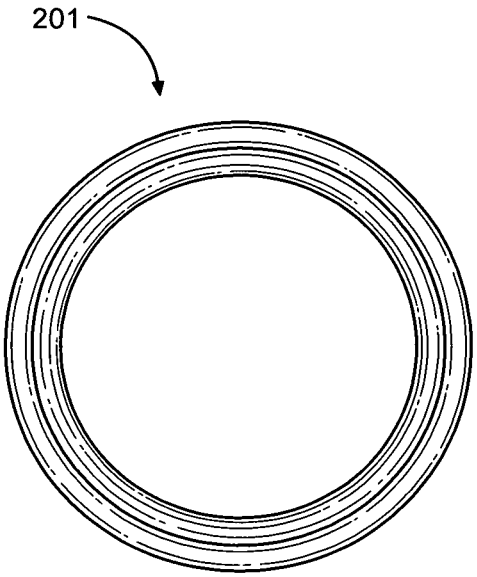
FIG. 6 is a cross section of the bottom of the segment of the segmented tube of FIG. 1.
Figure 7:
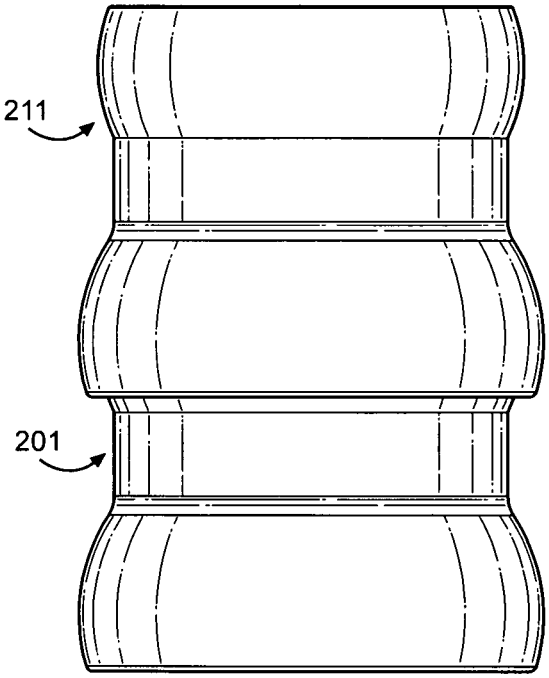
FIG. 7 is a side view of two segments of the segmented tube of FIG. 1 connected together.
Figure 8:
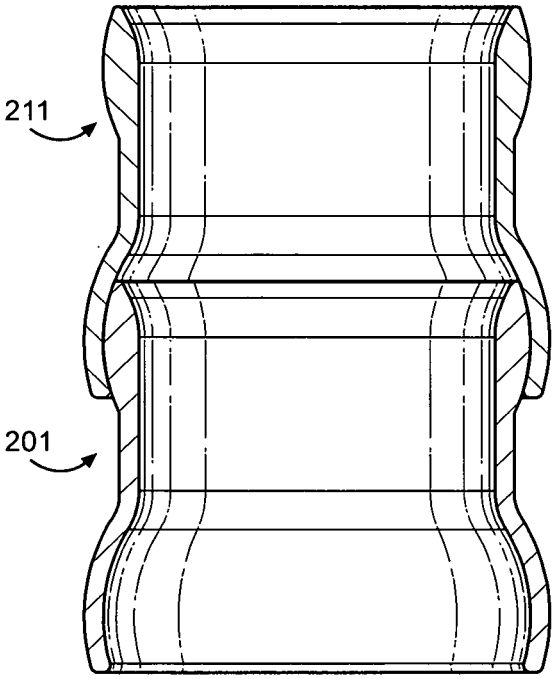
FIG. 8 is a cross sectional view of the two segments of FIG. 7.
Figure 9:
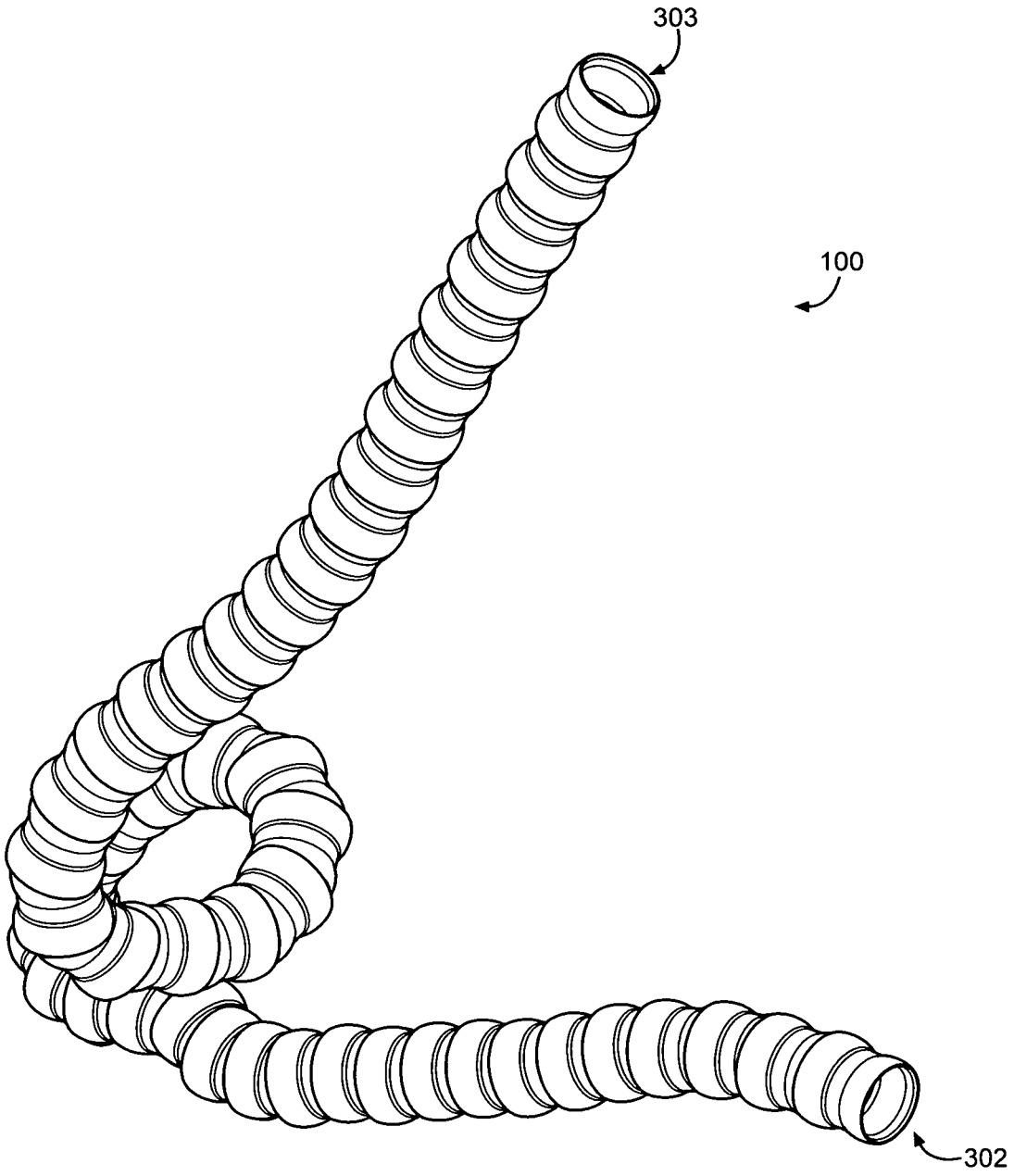
FIG. 9 is a perspective view of a twisted tube track.
Figure 10:
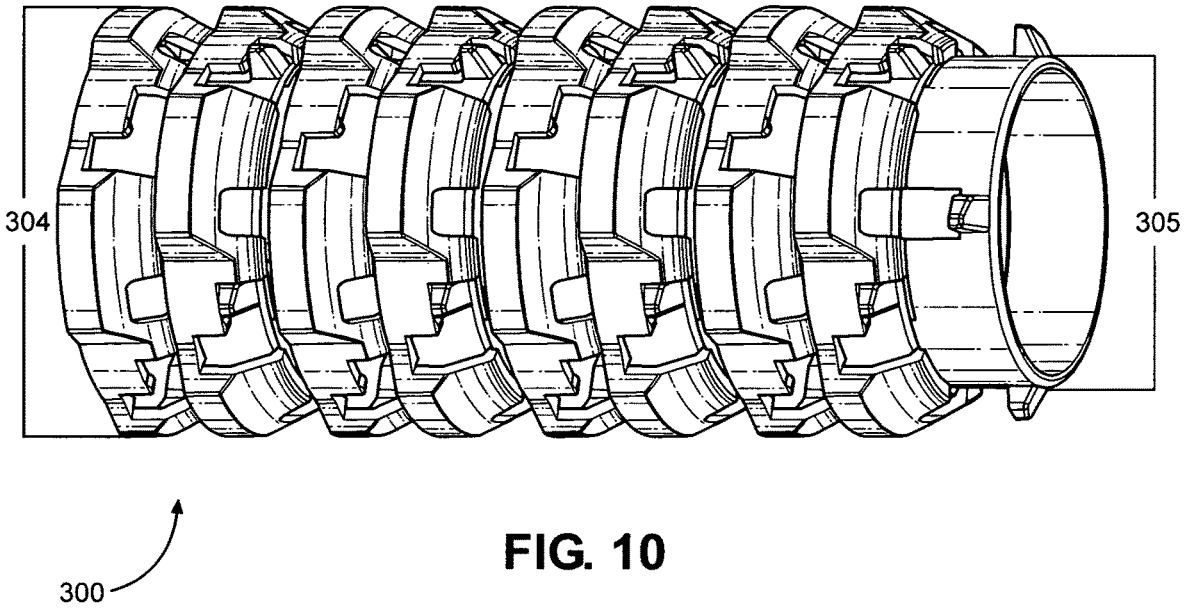
FIG. 10 is a perspective view of another embodiment of a segmented tube connected together.
Figure 11:
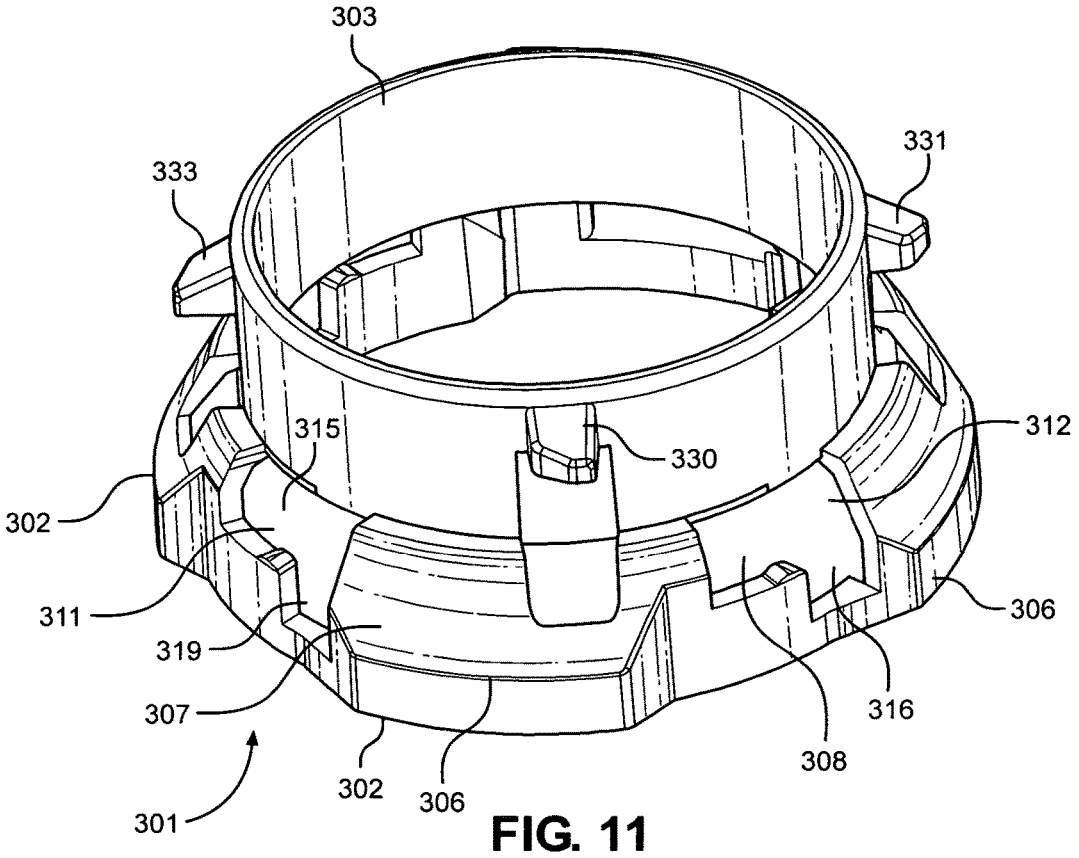
FIG. 11 is a perspective view of a segment of the segmented tube of FIG. 10.
Figure 12:
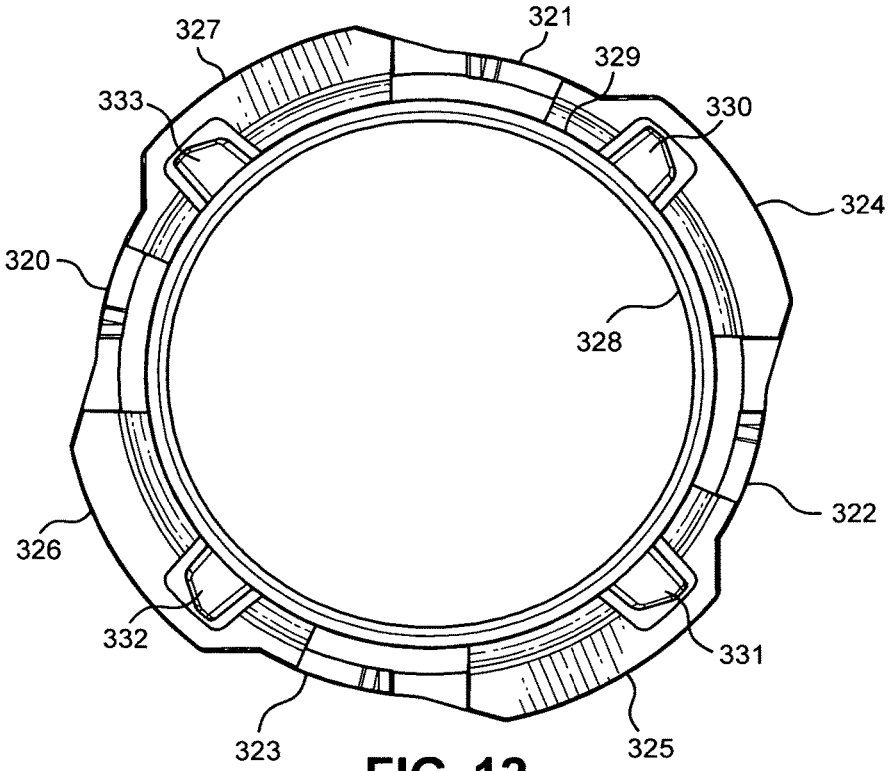
FIG. 12 is an overhead view of the segment of FIG. 11.
Figure 13:
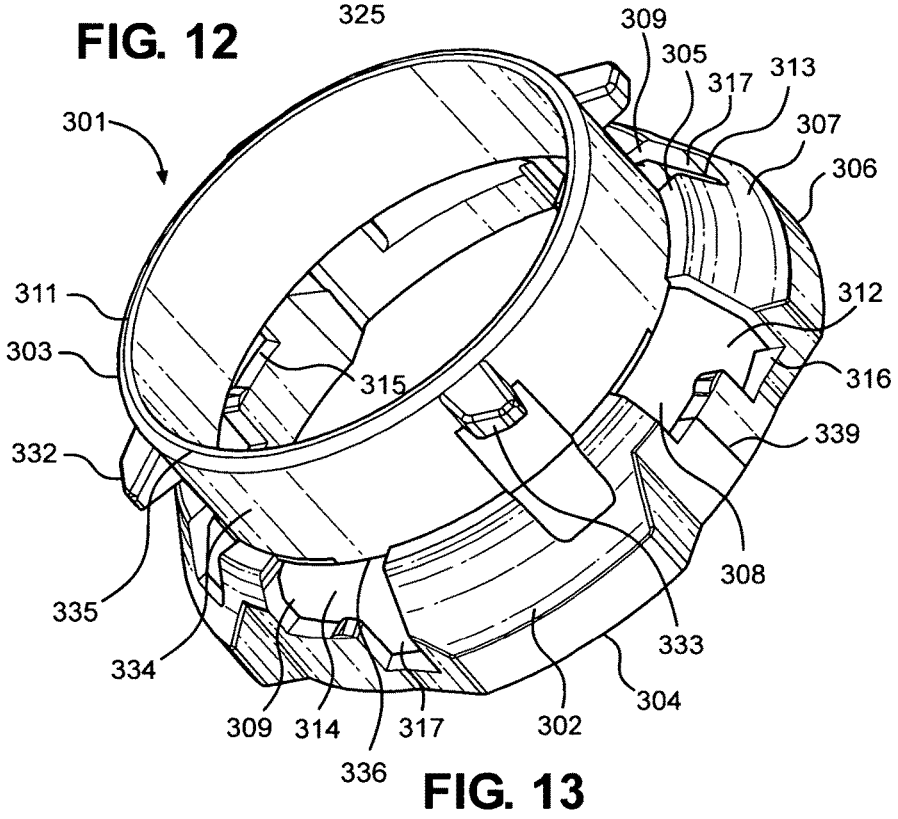
FIG. 13 is a another perspective of the segment of FIG. 11.
Figure 14:
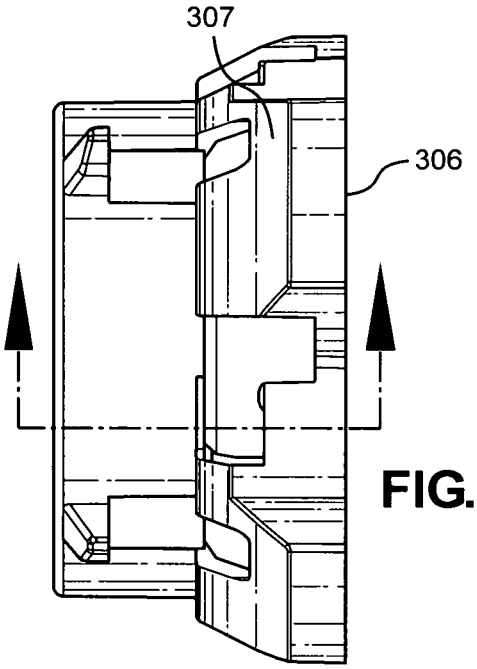
FIG. 14 is side view of the segment of FIG. 11.
Figure 15:
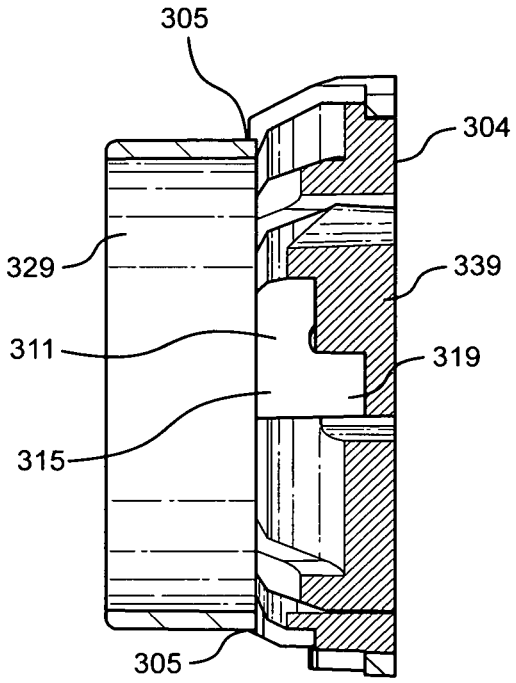
FIG. 15 is a cross sectional view of the segment of FIG. 14.
Figure 16:
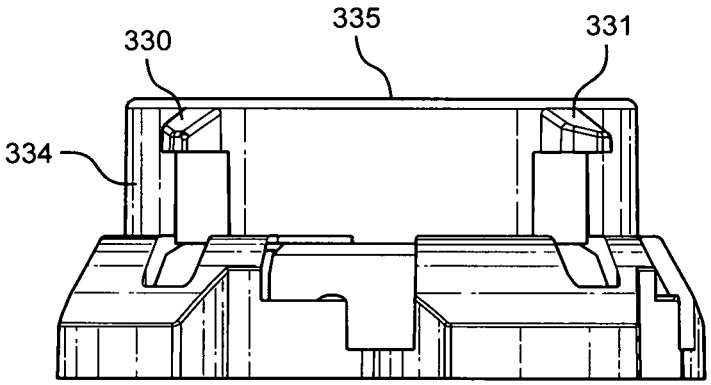
FIG. 16 is another side view of the segment of FIG. 11.
Figure 17:
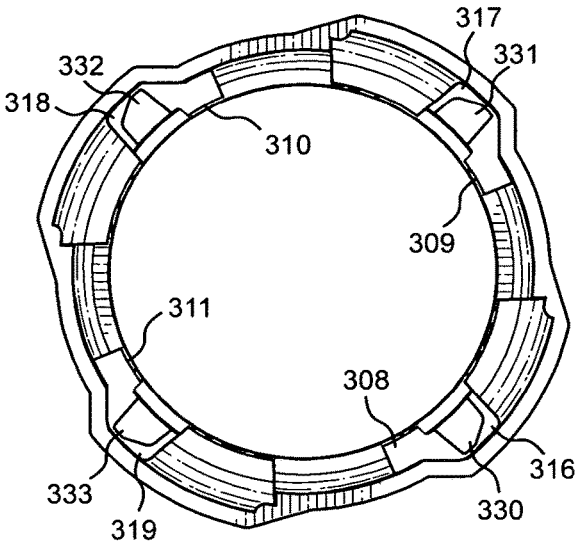
FIG. 17 is an overhead view of the segment of FIG. 11.
Figure 18:
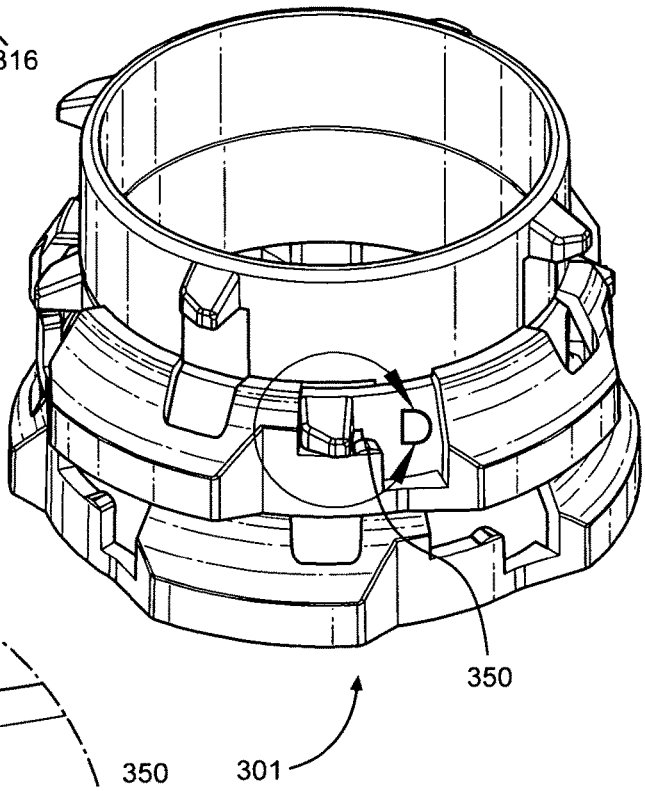
FIG. 18 is a side view of another embodiment of the two interlocking segments.
Figure 19:
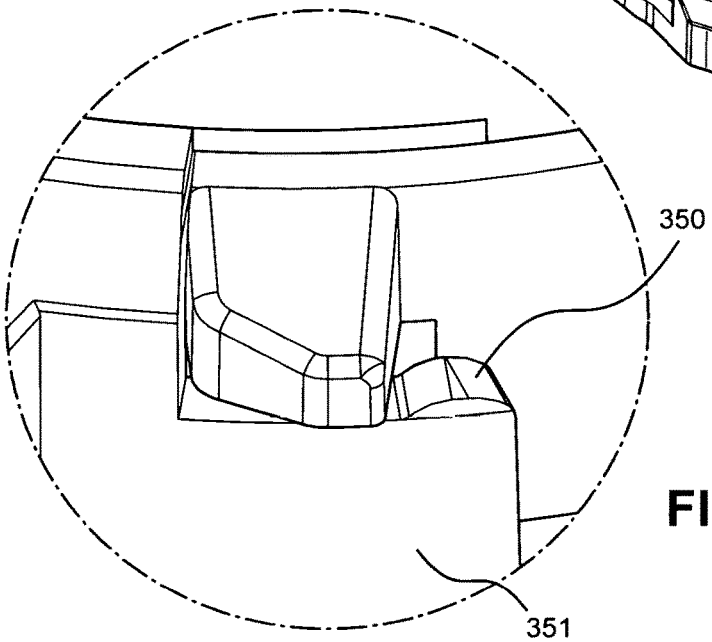
FIG. 19 is a close up view of the embodiment of FIG. 18.
Figure 20:
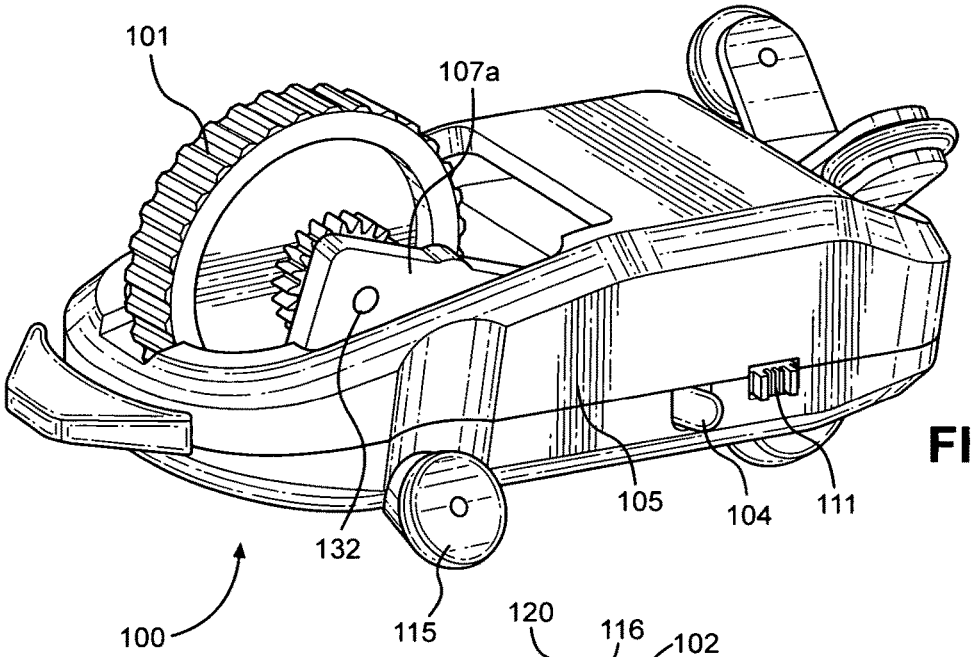
FIG. 20 is a perspective view of a toy tube car.
Figure 21:
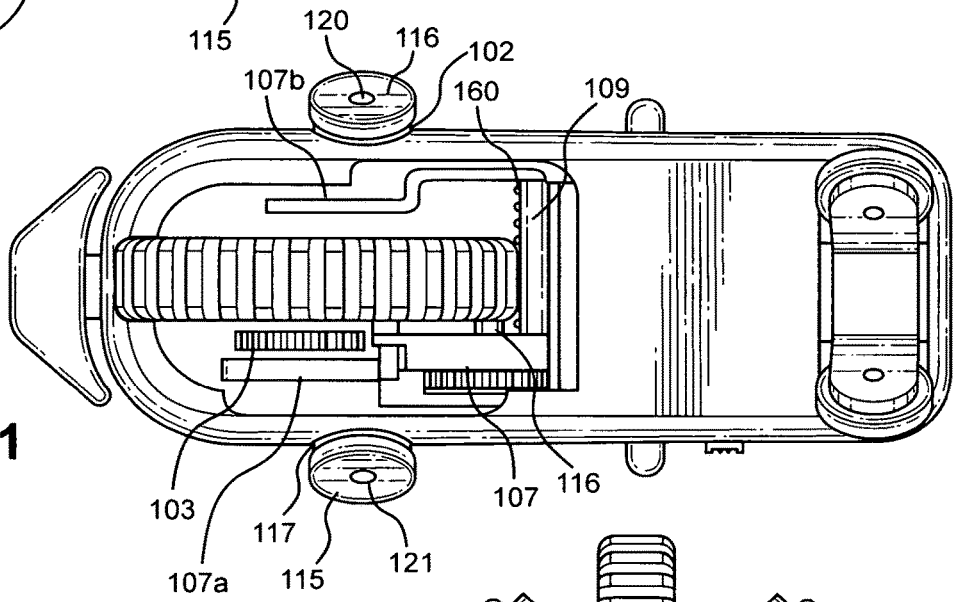
FIG. 21 is a top view of the toy tube car.
Figure 22:
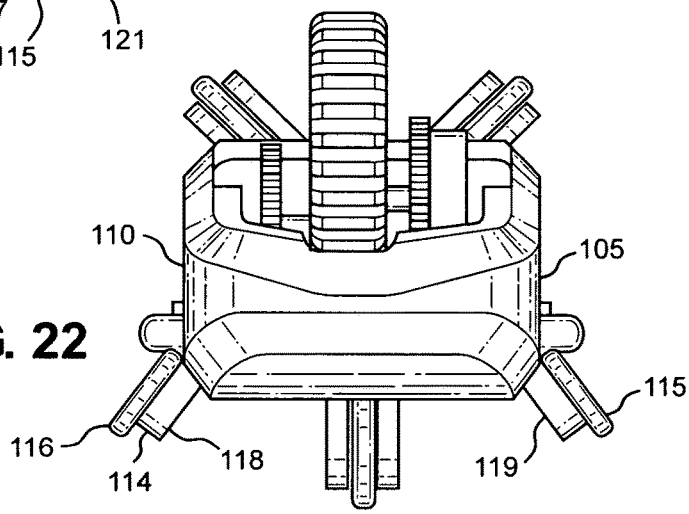
FIG. 22 is a front view of the toy tube car.
Figure 23:
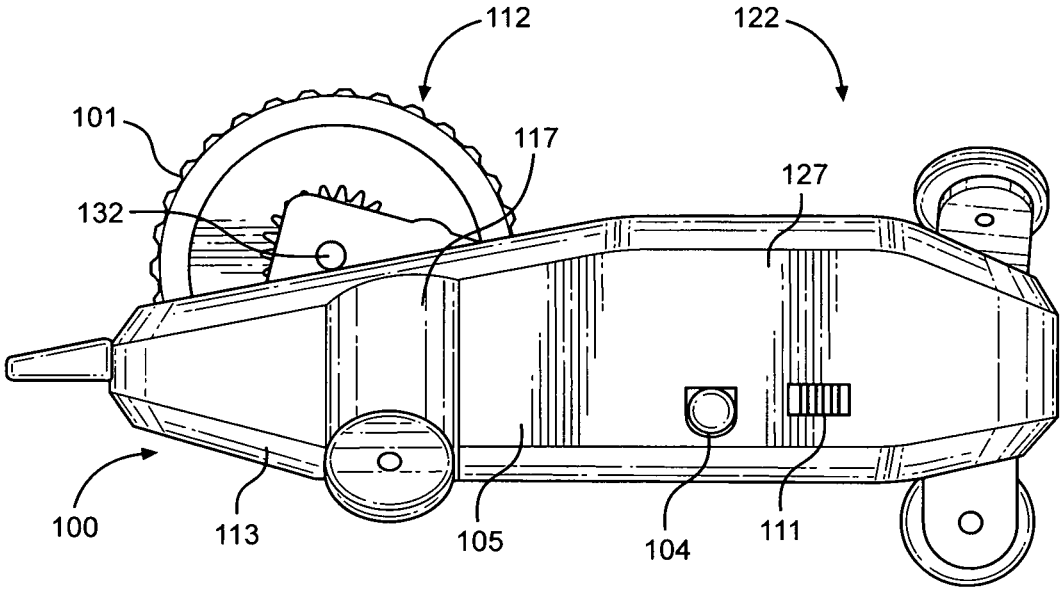
FIG. 23 is a side view of the toy tube car.
Figure 24:
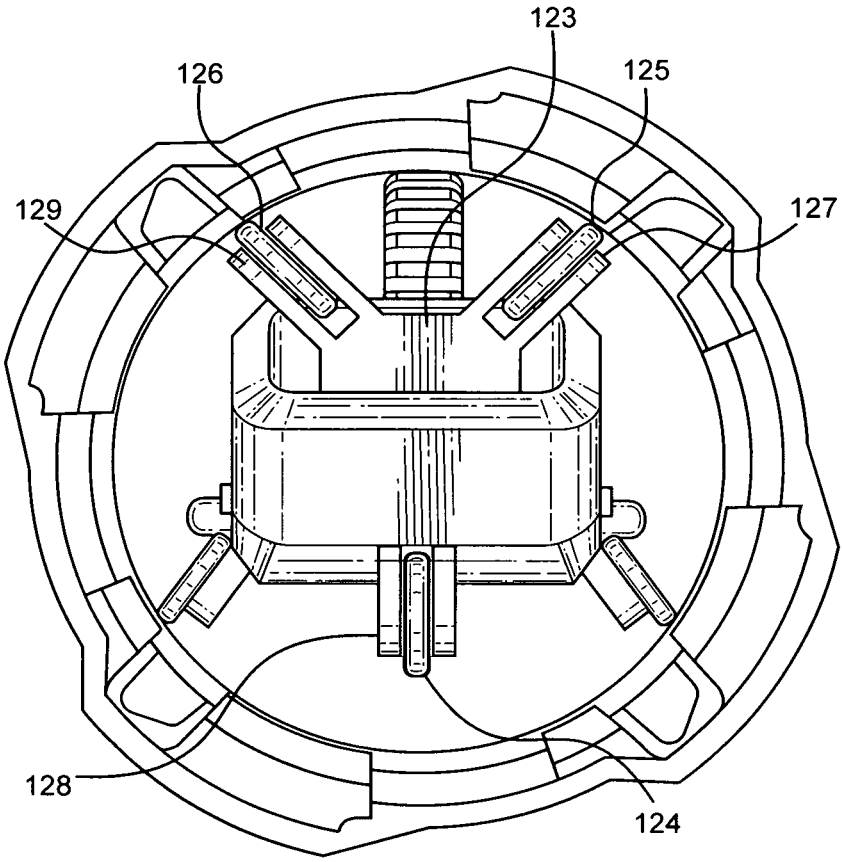
FIG. 24 is a rear view of the toy tube car in a tube.
Figure 25:
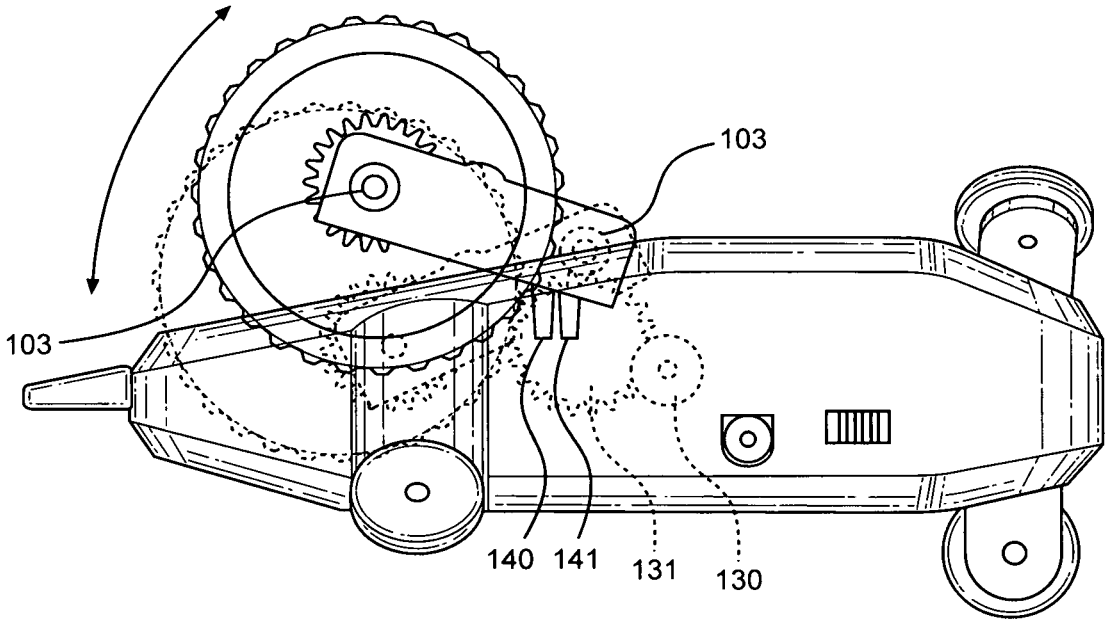
FIG. 25 is a partial cross section of the mechanism of the toy tube car showing the gear attachment to the motor, and the free movement of the drive wheel.
Figure 26:
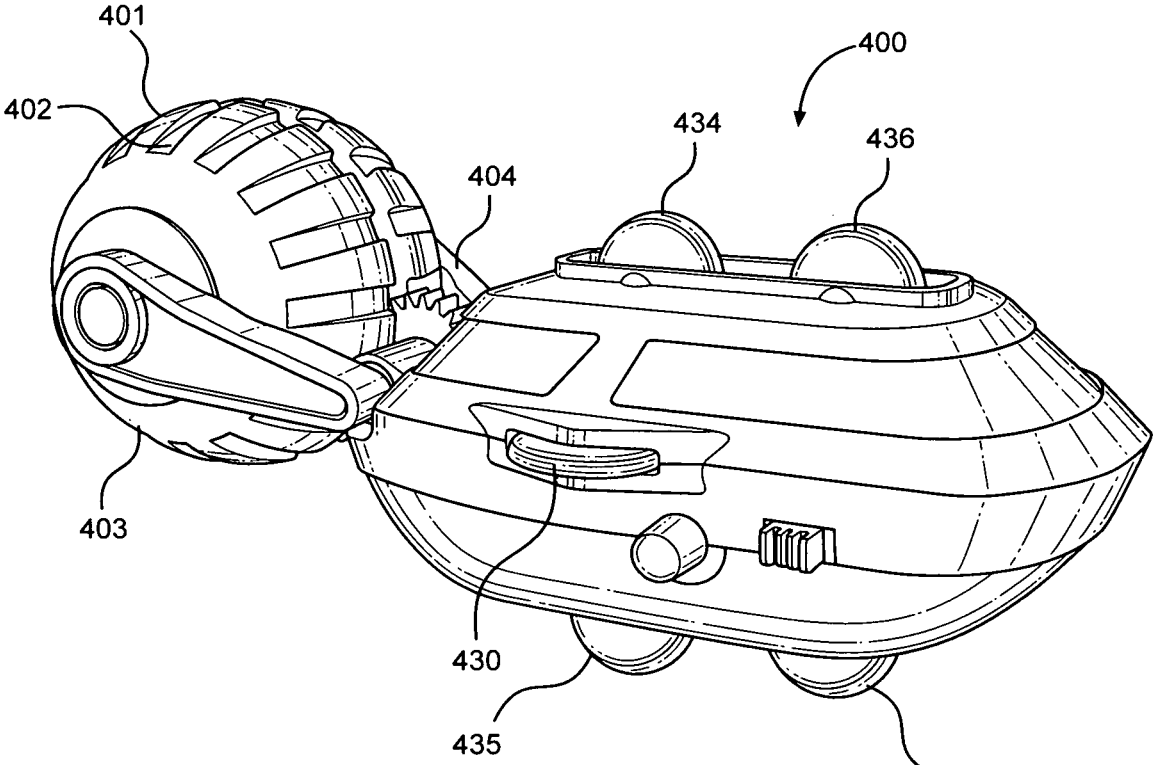
FIG. 26 is a rear perspective view of another embodiment of the toy car.
Figure 27:
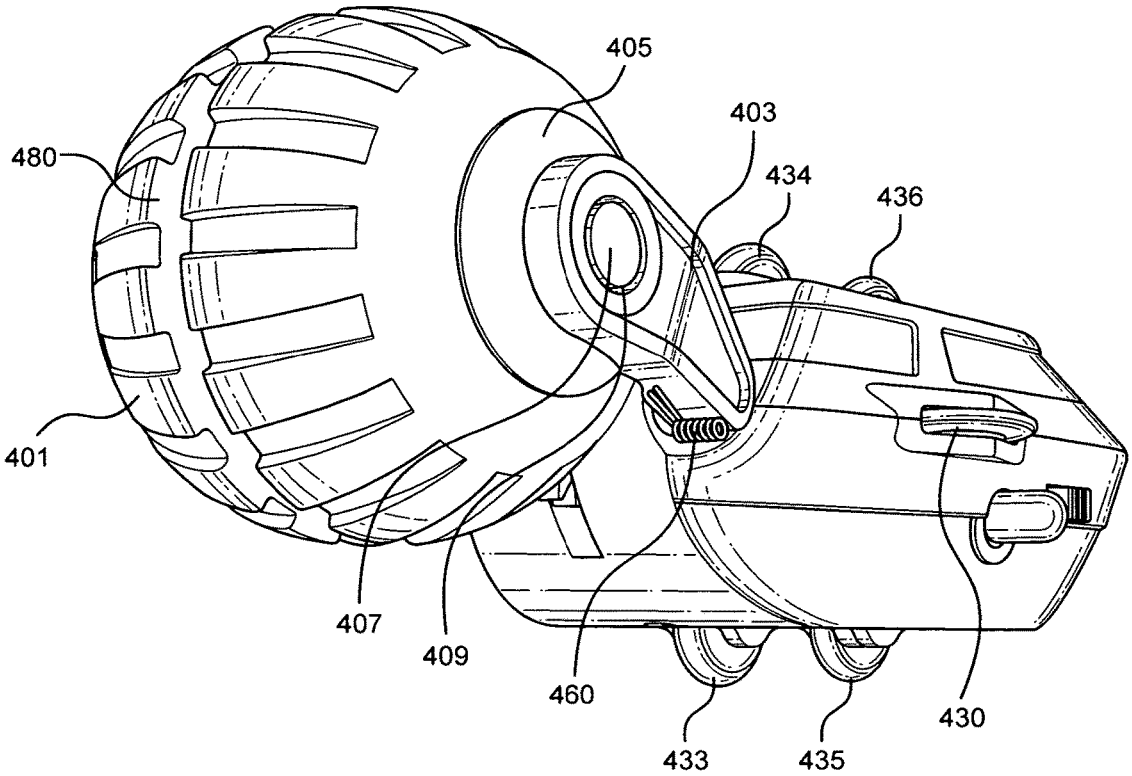
FIG. 27 is a front perspective view of the toy car of FIG. 26.
Figure 28:
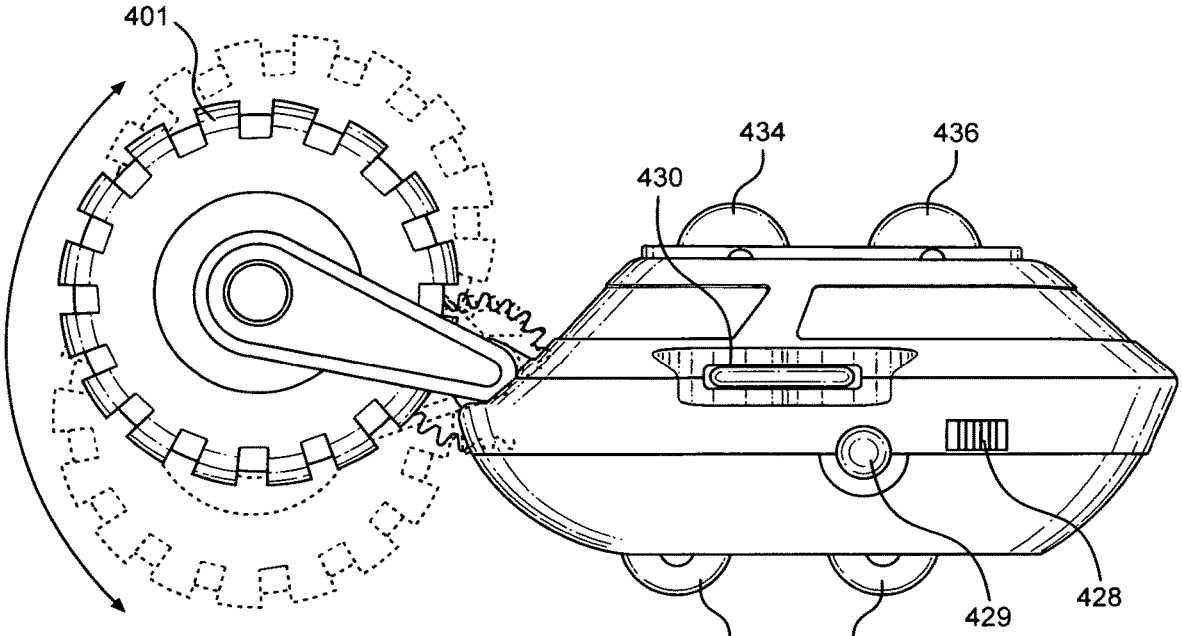
FIG. 28 is a side view of the toy car of FIG. 26.
Figure 29:
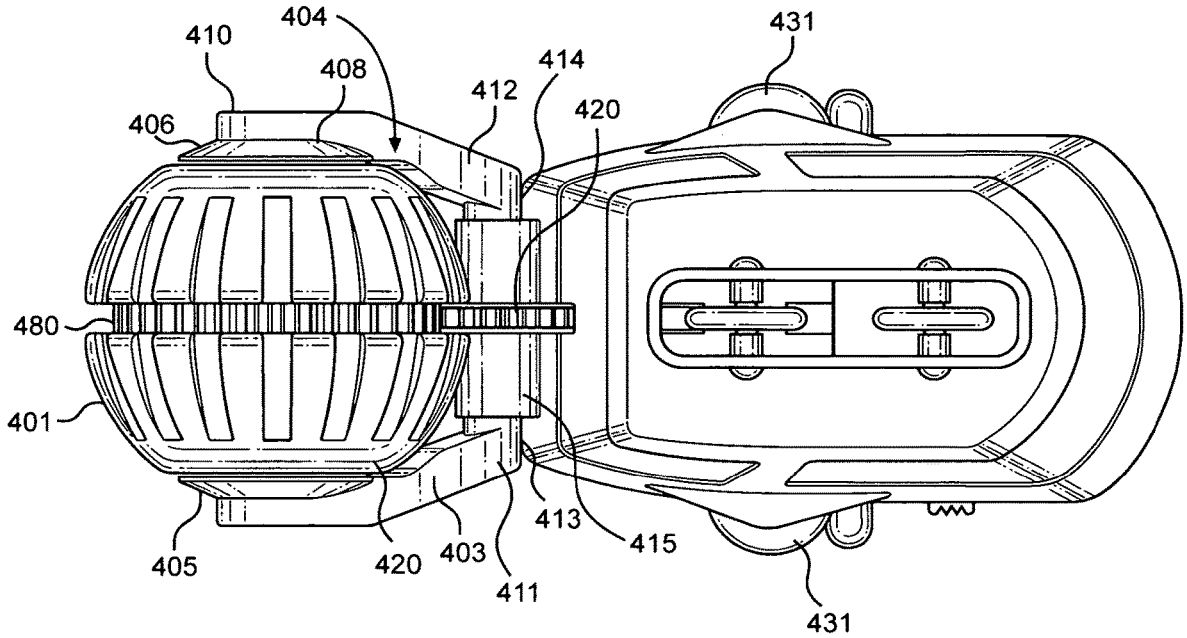
FIG. 29 is a top view of the toy car of FIG. 26.
Figure 30:
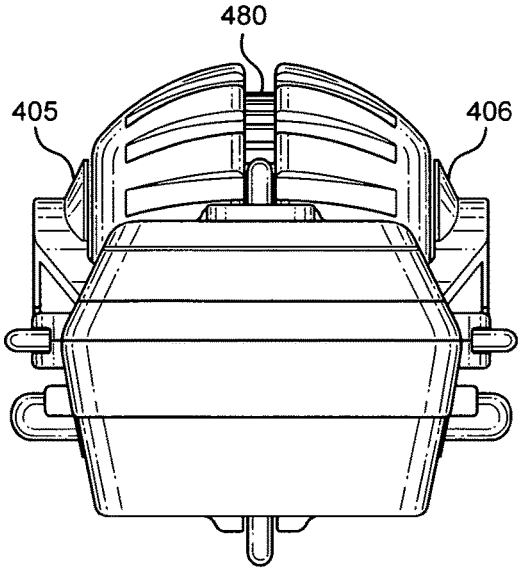
FIG. 30 is a rear view of the toy car of FIG. 26.
Figure 31:
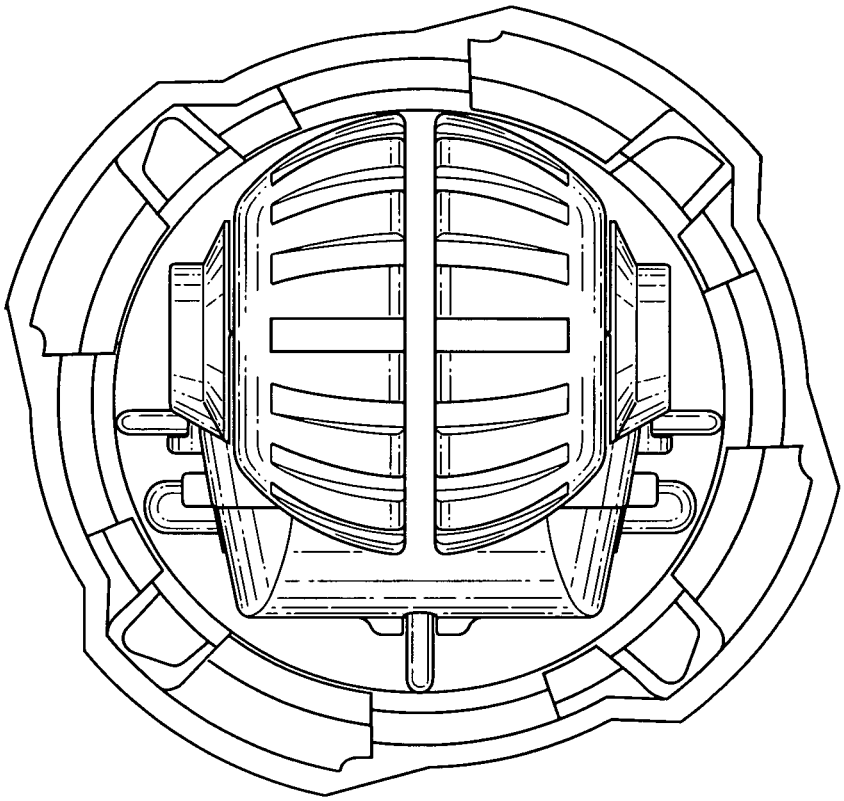
FIG. 31 is a front perspective view of the toy car of FIG. 26 as it transits the tube.
Figure 32:
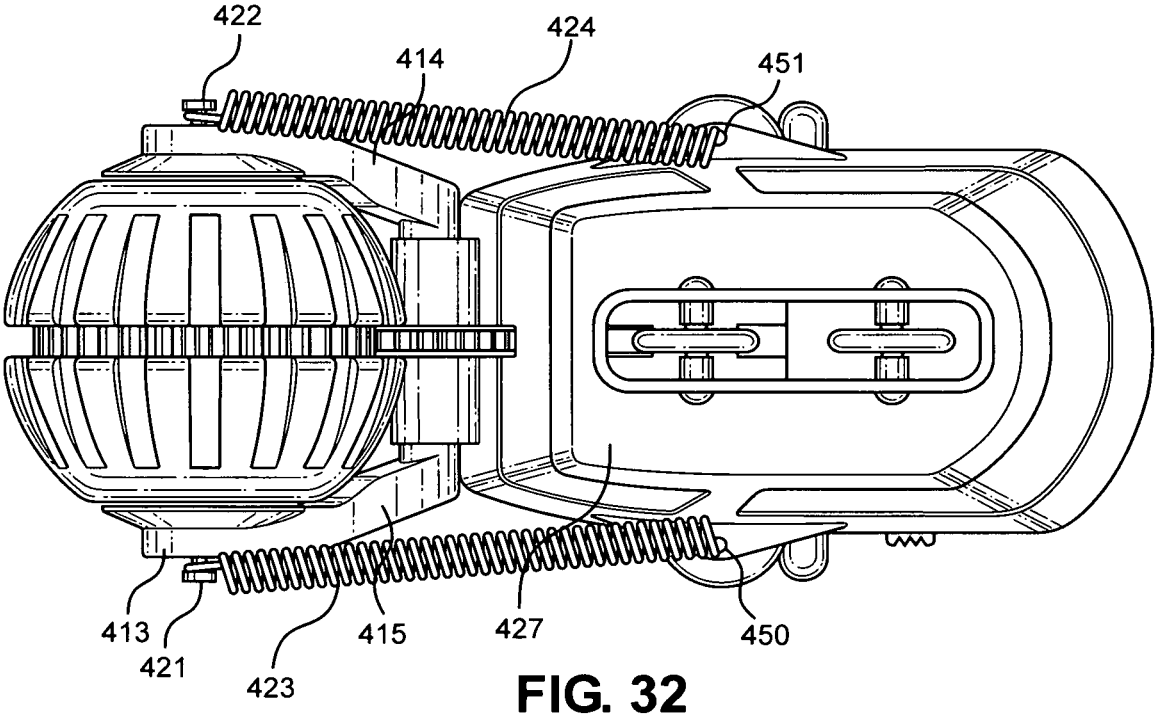
FIG. 32 is an overhead view of the toy car of FIG. 26 with an added feature.
Figure 33:
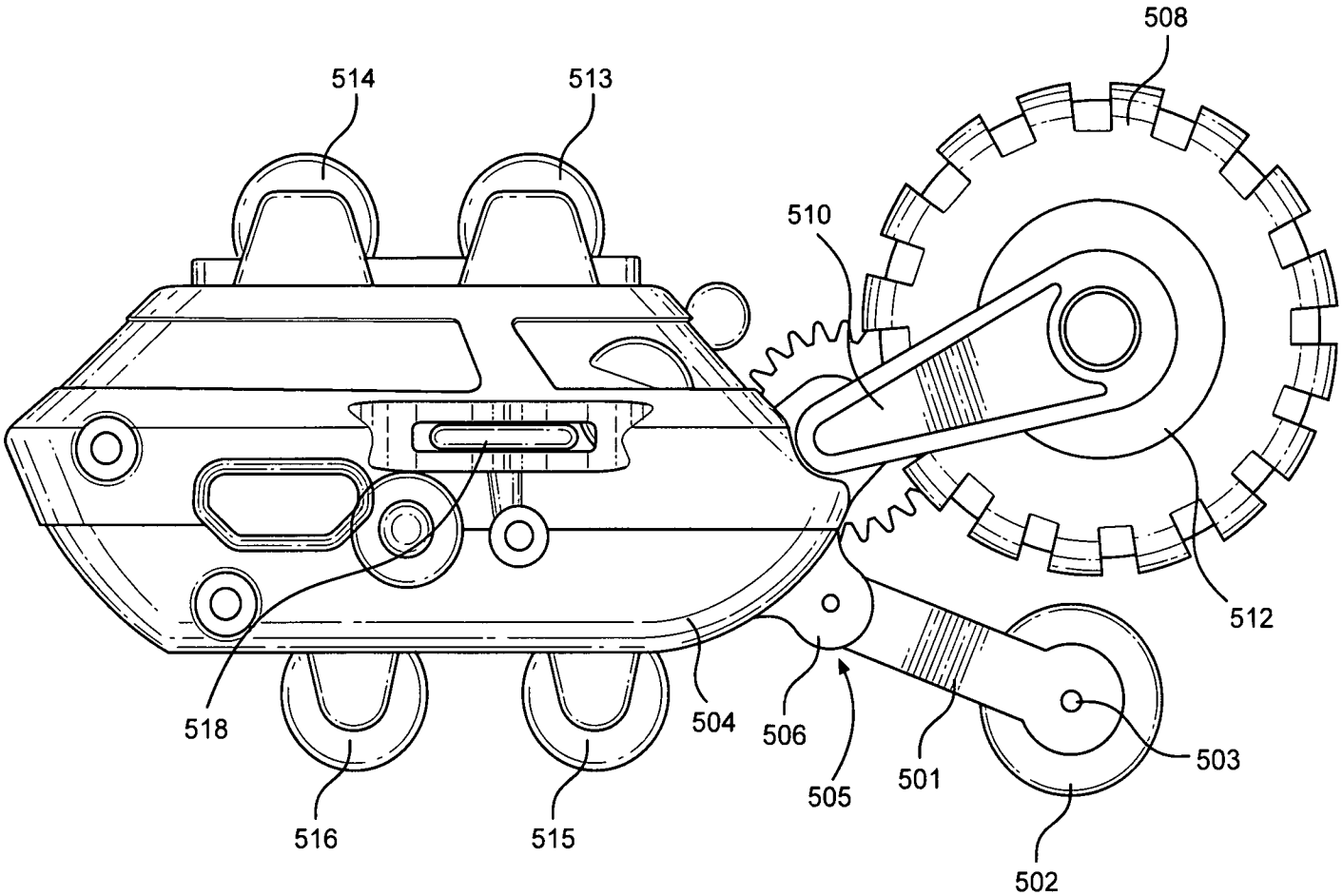
FIG. 33 is a first side view of another embodiment of the toy car of FIG. 26.
Figure 34:
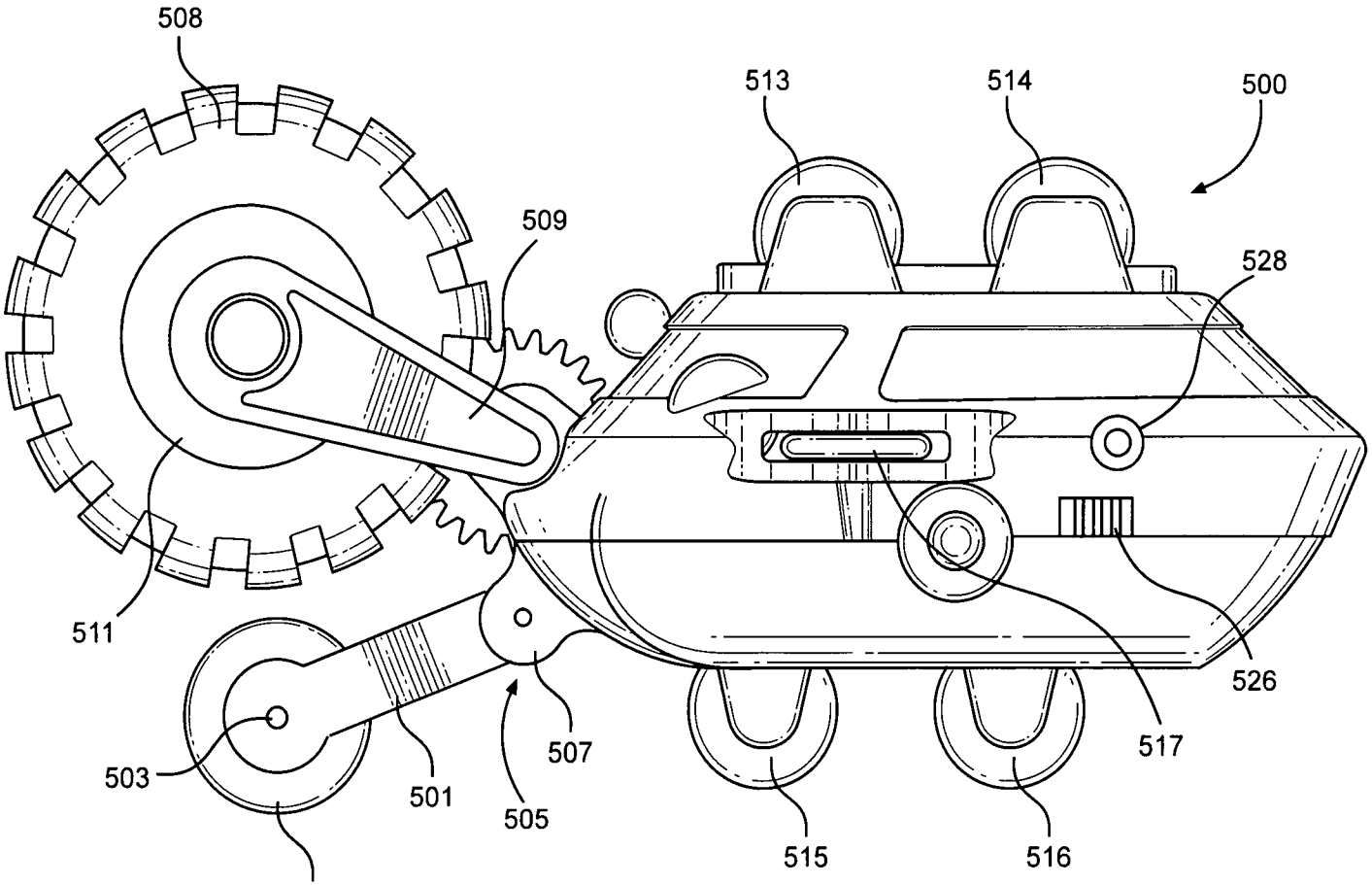
FIG. 34 is a second side view of the embodiment of the toy car of FIG. 33.
Figure 35:
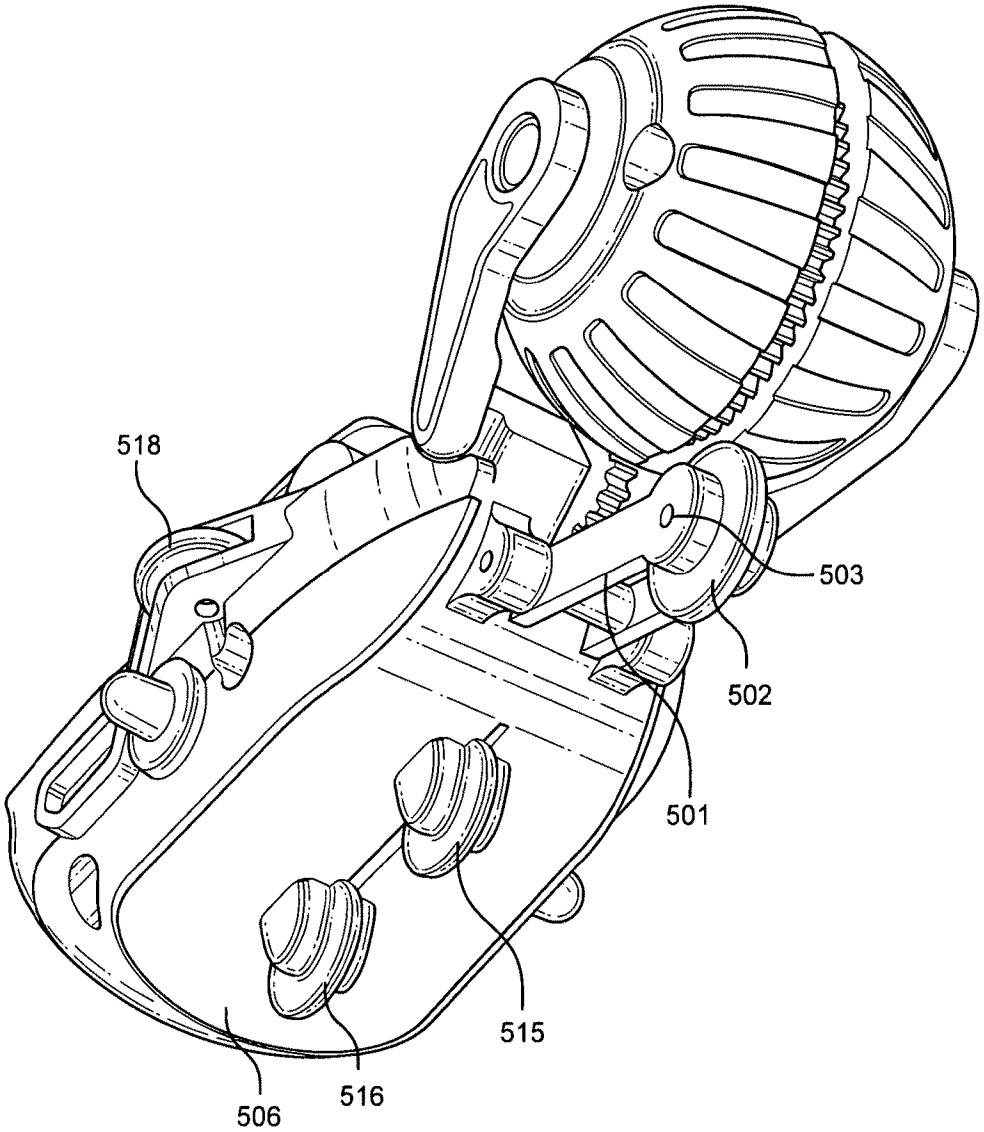
FIG. 35 is an underside perspective view of the toy car of FIG. 33.
Figure 36:
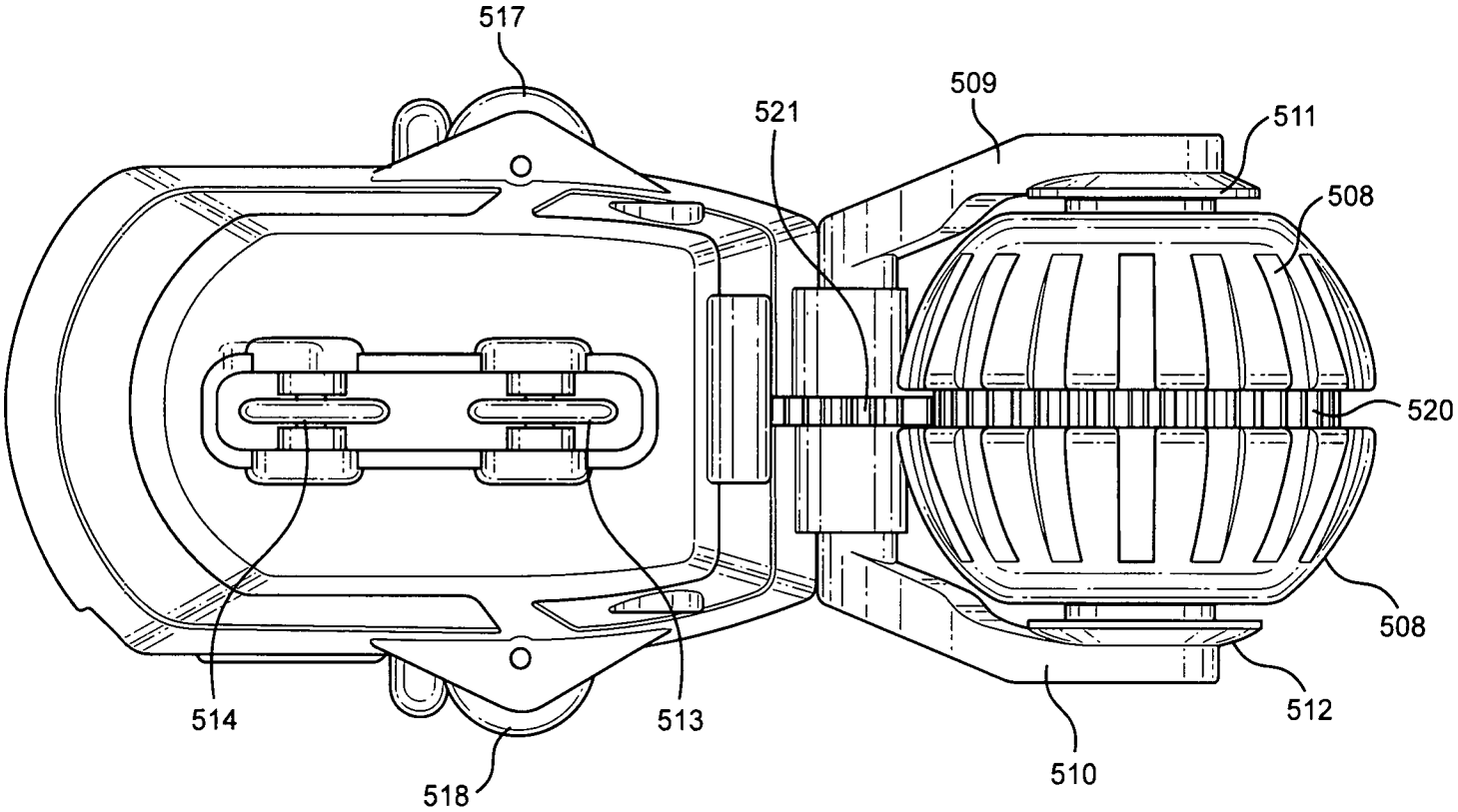
FIG. 36 is a top view of the toy car of FIG. 33.
Figure 37:
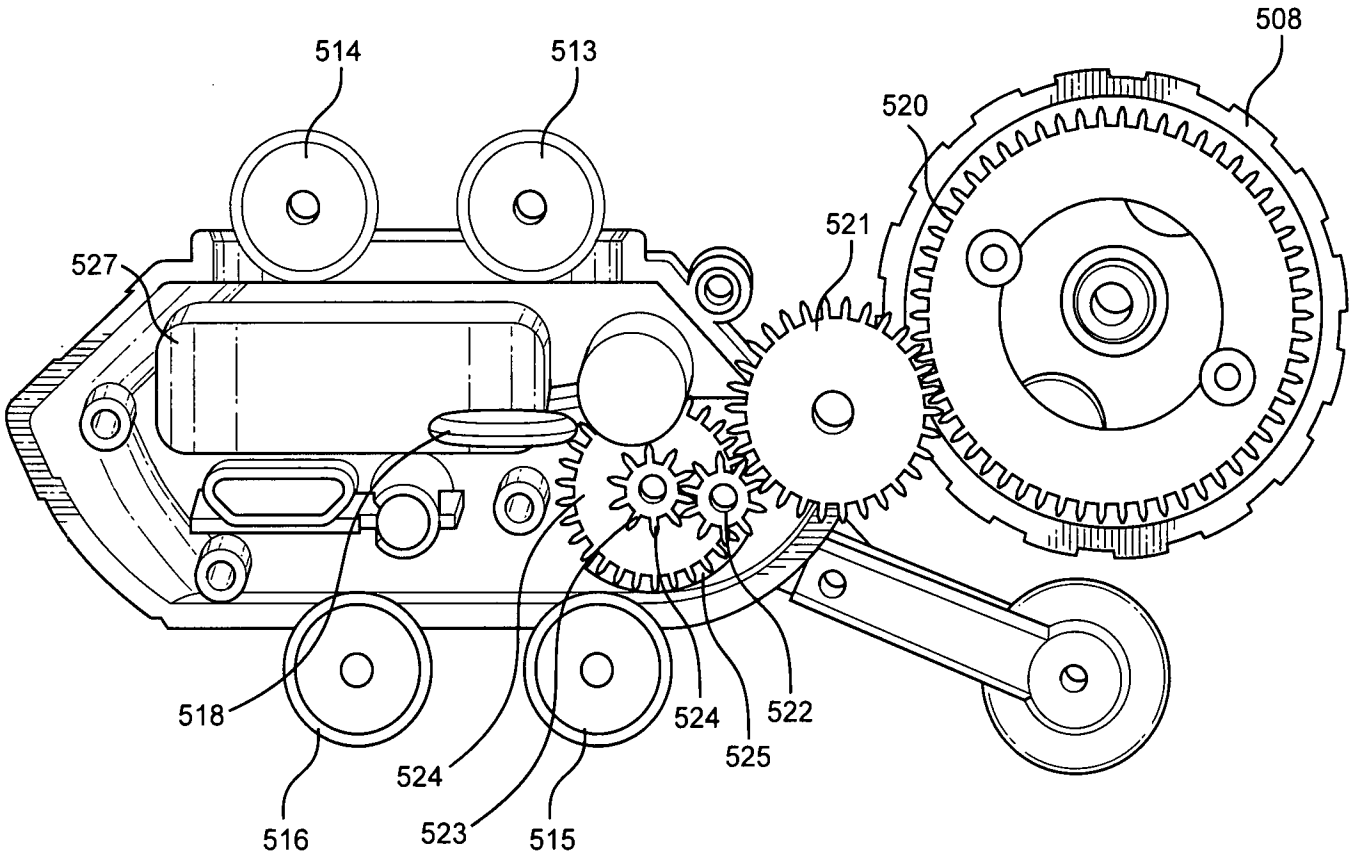
FIG. 37 is a cross-section view of the toy car of FIG. 33.
Figure 38:
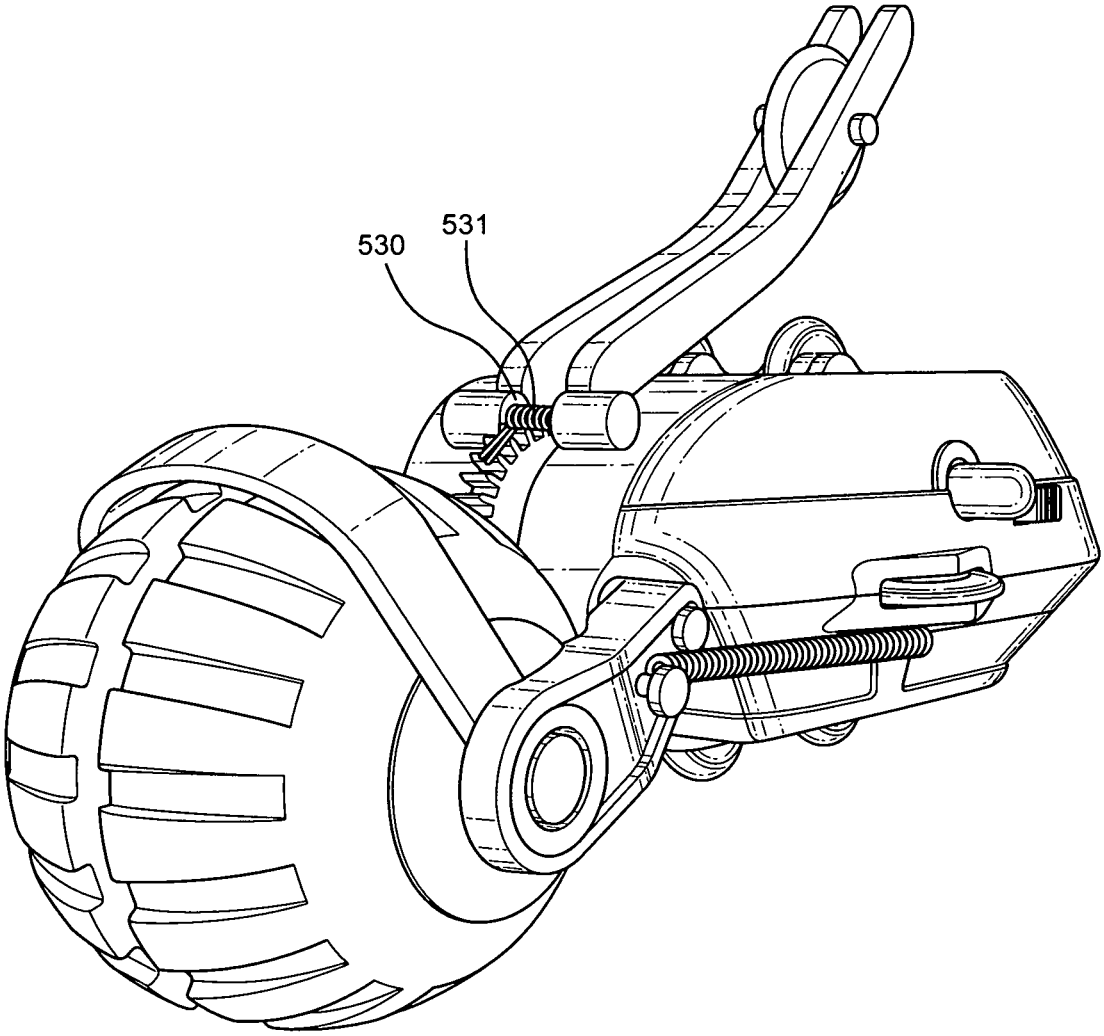
FIG. 38 is a front perspective view of the toy car showing the connection of a torsion arm.

In the present disclosure a toy tube car 100 can travel through a tube track composed of a first segmented tube track 200 or a second embodiment of a segmented tube track 300. The connections that the track can be either straight or curved.

In one embodiment, the tube track 200 which is a ball and socket tunnel assembly through which the toy tube car 100 travels is composed of reversibly attachable segments. The segments 201 are made out of a resilient plastic material which has an elastic memory, meaning that the segment retains its shape, and yet has an elasticity that allows for a certain reasonable amount of stretching. Each segment 201 is integrally composed of a base or socket 202, a neck or middle section 203 residing on the base 202 and a head or ball 204, supported on the neck or middle section 203. The base 202 is the widest section of the segment 201, and the neck or middle section 203 is the narrowest section of the segment 201. In one embodiment, the sides 205 of the base 202 gently and roundingly flare away or outwardly at the perimeter 206 between the base 202 and the neck or middle section 203. Similarly, in another embodiment, the sides of 207 of the head 204 gently and roundingly flare away at the perimeter 208 between the neck or middle portion and the head 204.

More specifically, and in one embodiment, as an example, the segment 201 is about 1.659 inches tall, from the bottom of the base (ball) 202 to the top of the head (socket) 204. The height of the neck 203 measured from perimeter 206 to perimeter 208 is 0.354 inches. The outside width of the neck is 1.610 inches wide. The inside width of the neck is 1.45 inches, the outside width of the base 202 is 1.913 inches, and the outside width of the ball or head 204 is 1.743 inches.

In this embodiment, the height of the segment 201 is 1.659 inches. in another embodiment the width of the plastic forming the base 202 is 0.080 inches thick. The radius of the base 202 is 0.805 inches, and the thickness of the head (socket) 204 is 0.147 inches and has a radius of 0.725 inches. These figures may vary while maintaining the ratio and the proportional ability of the wheels of the toy car to maintain contact with the walls of the segmented tube 200.

To connect the segments 201, the ball or head 204 is inserted into the base 202 of another segment 211. The curved radius of the ball or head 204 of the first segment 210 can enter only part way into the base 202 of a second segment 213 as the circumference of rim 212 of the base is too narrow for the entire ball 204 to easily fit through when the rim 212 connects with the ball 204 at the midpoint of the ball 204, where the outer diameter of the ball 204 is greatest. However, because the plastic used to make the track segment 201 has elasticity and memory, the ball 204 can be pushed into the base 202 with a modicum of force, making a strong link or connection as the plastic of the base 202 of the second segment envelopes the ball or head 204 of the first segment 212

In another embodiment 300 of the tube is made up of reversibly interlocking segments 301. The segments 301 are made out of a resilient plastic material which has an elastic memory, meaning that the segment retains its shape, and yet has an elasticity that allows for a certain reasonable amount of stretching The interlocking segments 301 includes a receiving base 302 and a locking top 303. The circumference 304 of receiving base 302 is larger than the circumference 305 of the locking top 303. In one embodiment, the receiving base 302 has a vertical rim 306 extending at and above the circumference. In another embodiment, above the vertical rim 306 is an outwardly angled wall 307 to which the vertical rim 306 is integrally attached. Across both the vertical rim 306 and the angled wall 307 is a plurality of a capital"L" shaped cutouts or punch outs 308, 309, 310, 311. In one embodiment, the elongated section of the "L" 312, 313, 314, 315 runs parallel with the circumference 305 of the locking top 303, with a rectangular or square notch 316, 317, 318, 319 positioned at the foot of the "L" 312, 313, 314, 315. In one embodiment, the square notch 316, 317, 318, 319 is positioned below the elongated section of the "L." In other instances, there just a notch. In yet another embodiment, the notch is connected to a curved cutout leading to the notch.

It should be noted that that the circumference 304 of receiving the receiving base does not need to be round. In one embodiment, the receiving base 302 has four sides 320, 321 322, 323. In another embodiment, the corners 324, 325, 326, 327 of the receiving base are rounded. In yet another embodiment, one of the cutouts 308, 309, 310, 311 is positioned on each of the four sides.

Positioned above and about the receiving base 302 is the locking top 303. In one embodiment, the locking top 303 is integrally molded with the receiving base 302. In another embodiment, the locking top 303 is screwed or glued to the receiving base 302. Any number of means of attachment known in the art are acceptable. In one embodiment, the locking top 303 is round on its inside circumference 328. In another embodiment the outside circumference 329 is round.

A plurality of locking projections 330, 331, 332, 333 extends from the wall 334 of the locking top 303 that forms the round circumference. The locking projections 330, 331, 332, 333 extend outward from just below the rim 335 positioned around the top of the wall 334. In one embodiment, the locking projections 330, 331, 332, 333 are wedged shaped, sloping downward away from the wall 334.

The tubes 300 and the tube segments 301 can be any dimension, long as the wheels of the toy tube car 100 can be in communication with the walls of the tube segment with enough pressure on the wheels to propel the toy tube car 100 forward or backward. The ratios of the dimensions of the tube segments 301 are generally are fixed, although they can be varied as long as the tube segments can still be locked together to form a continuous wall inside of the formed tube 300.

In one embodiment, the locking top 303 has an internal diameter of 1.447 inches. The width of the plastic of the walls of the locking top 303 is 0.058 inches (58/100 inches). The diameter of the receiving base 302 measured from the outside of the walls is 1.981 inches, and the height of the tube segment 301 is 0.890 inches. It should be noted that the height of the locking top 303 can vary irrespective of the ratios.

In one embodiment, when the plurality of interlocking sections 301 are assembled, the inside of the segmented tube track 300 is reasonably smooth, allowing for a specialized toy car to travel through the tube track 300. All segmented tubes 200, 300 can be transparent, translucent, or opaque. The tubes 200, 300 can be of any color. They are usually made of plastic, strong enough for a toy car to travel within the tubes 200, 300.

To form segmented tube 300 from the plurality of segments 301, the rim 335 positioned around the top of the wall 334 of the locking top 303 of a first segment 337 is positioned behind and in alignment with the opening or proximal end 336 of the receiving base 302 of a second segment 338. The rim 335 is narrower than the proximal end 336 of the receiving base 302 except for the locking projections 330, 331, 332, 333 extending outward from just below the rim 335 positioned around the top of the wall 334. Hence, to connect the segments 301, the rim 334 of the first segment 337 is angled close behind the receiving the receiving base 302 of the second segment 338. One or two of the locking projections 330, 331 is (are) then inserted into respective notches 316, 317, such that they protrude. The rest of the locking top 303 is then pushed into the receiving base 302, and, as the material being used is plastic with both memory and resiliency, the receiving base 302 temporarily distorts enough so that the locking projections 332, 333 snap into respective notches 318, 319.

At this point, locking projections 330, 331, 332, 333 of the locking top 303 are positioned through notches 316, 317, 318, 319 of receiving base 302, so that locking projections are now in the elongated section of the "L" 312, 313, 314, 315. The locking top 303 is then rotated, so the locking projections 330, 331, 332, 333 are held against the body 339 of the receiving base 302 by friction.

Normally, the friction between the step 351 and the locking projection(s) are enough to secure the locking projection in place. However, in another embodiment, there is a protuberance 350 on top of the step which helps secure the locking projection in place.

There are an infinite number of holes and projections that this embodiment could use. In other words, there could be other methods to snap the pieces together. Similarly, there could also be parts that use the same mechanism described supra, but in this embodiment, the locking top 303 has an elongated curved body 340. This embodiment, and other segments curved at varying degrees and radii, allow the track to curve. In another embodiment, the locking top can be spiraled 341. In this segment, there can be an invariable number and shapes of the holes and the locking projections. The locking projections can have a number of shapes.

The vehicle 100 is designed to optimize contact with the track so that there is enough contact or friction to allow the vehicle 100 to be propelled along the track. Either track 200 or track 300 could be used.

In one embodiment there is a drive wheel 101. In one embodiment, this drive wheel is connected to the motor 102 by a series of gears 103. In yet another embodiment, instead of gears the drive wheel 101 is connected to the motor 102 by an elastic tread, elastic band, or chain. In one embodiment, the motor 102 is powered by a battery. In another embodiment, the motor is powered by a charge by means of a USB charging wire to a charging port 104 in the first side 105 of the vehicle 100. In another embodiment, charging port 104 is on the second side 110. In one embodiment, this charging port 104 allows for the charging of a battery within the toy vehicle. In another embodiment, the charging port 104 is positioned anywhere on the vehicle 100. In one embodiment, the charging port 104 is standard and operates by methods known in the art, including all supportive electronics. In another embodiment the electric motor (which in one embodiment, is a DC motor) is powered by a battery. In yet another embodiment, the toy vehicle 100 has an on-off switch 111 anywhere on the vehicle. 100. In the vehicle 100 shown, the on-off switch 111 is positioned near the charging port 104 on first side 105.

The drive wheel 101 is held in place by an axle 132 which in turn is held in place by either a forked axle support 150 having two axle supports 107*a*, 107*b* that pivot about the same cross sectional bar 109 that extends between the two sides 105, 110 of the vehicle 100.

The drive wheel assembly 112 which includes the drive wheel 101, gears 103, and the forked axle 150, using methods known in the art, is resiliently biased upward by springs (not shown) or other resilient structures. Biasing the drive wheel assembly 112 upward allows for a frictional and continuous contact of the drive wheel 101 against the inside wall of the segmented tube 200 or 300, allowing the vehicle 100 to move backwards or forwards.

There are two ways to drive the drive wheel. In one embodiment, the motor 130 drives a gear 131 which drives the geared drive wheel 101. The positioning of the motor 130 and the drive gear 131 helps position the drive wheel 101 against the walls of the tubes. In another embodiment, springs and other resilient members keep the geared drive wheel positioned against the wall of the inside of the tube track(s). In yet another embodiment, resilient springs 140, 141 are positioned so as to push up on the axle supports 107*a*, 107*b*. In another embodiment, a torsion spring 160 can be used to either push up against cross-bar 109 or one end of the torsion spring 160 can be pushing up either axle support 107*a* or 107*b* while the body of the spring is secured to either or both of the sides 105, 110 of the vehicle, or any internal extension. More than one spring can be used, and more than one kind of spring can be used.

Additionally, the toy vehicle 100 has a plurality of smaller wheels for guidance and additional traction through the segment tunnel. Near the front 113 of the vehicle are a set of two wheels 115, 116, each of which extend at an angle from opposite sides 105, 110. In one embodiment, the wheels 114, 115 are positioned on the side and near the front of the vehicle. In one embodiment, wheel supports 118, 119 just out from well 116, 117. In another embodiment, there are no wells on the vehicle. In another embodiment, micro axles or pins 120, 121 hold the wheels 114, 115 to the wheel supports 118, 119. In another embodiment, the wheel supports 118, 119 are positioned at a 135 degree angle. In another embodiment the wheels 114, 115 positioned at a 120 degree angle.

In the rear 122 of the vehicle 100 is a tri-sectional support 123 for three wheels 124, 125, 126. The tri-sectional support is held on to the rest of the body 127 of the toy vehicle 100 by means known in the art. In one embodiment, the tri-sectional support 123 is positioned at the very end of the vehicle 100. In another embodiment, as shown, the tri-sectional support 123 is positioned within the body 127 of the vehicle 100. At each end of the wheel supports 127, 128, 129 are the wheels 124, 125, and 126. The wheel supports are long enough and positioned such that the wheels are in communication with the walls of the tube. In the embodiment shown, two wheels, 125, 126 are positioned 90 degrees from each other and each are positioned 135 degrees each other, including but not limited to 120 degrees from each other.

In yet another embodiment, the rear wheels of the car are attached by axles directly to the body of the vehicle and can be perpendicular or angularly positioned.

In yet another embodiment, a vehicle 400 has a tumbler drive wheel 401 positioned at its front. The tumbler drive wheel 401 has a round core, with a tread 402 integral with and comprising the outside of the tumbler. This tread, which can be plastic in one embodiment but textured rubber in another embodiment, provides traction along the inside of the tubes, and particularly along a bumpy inner track surface. The tumbler drive wheel 401 is supported by a support arm 403, 404 on each side of the tumbler wheel drive wheel 401 such that the tumbler drive wheel 401 can rotate forwards or backwards. In one embodiment, the support arms 403, 404 are tension arms 403, 404 having a resiliency that keeps the tumbler drive wheel 401 pressed up against the inside wall of the segmented tube. In an alternative embodiment, and in the embodiment shown, two end caps 405, 406 on either side of the ball having miniaxles 407, 408 which pass through an opening 409, 410 on each of the support arms. In another embodiment, there are not two miniaxles, but one axle that passes through the tumbler drive wheel 401. In yet another embodiment, the end caps are affixed to the tumbler drive wheel 401.

In one embodiment, the two support arms 403, 404 are connected to the vehicle body by means of pivot arms 413, 414 at the distal ends 411, 412. The distal ends 411, 412 of the support arms 403, 404 are angular to make it easier to hold the pivot arms 413 414.

In one embodiment, pivot arms 413, 414 are positioned within a hollow tube 415. In one embodiment, this hollow tube 415 is integral and molded with the body 427. In another embodiment, pivot arms 413 414 are connected such that they comprise one pivot axle 417. In another embodiment, the pivot arms are 413, 414 independent of each other.

Positioned on or around the middle of the hollow tube 415 is a tumbler drive wheel gear 420 which meshes with the center gear teeth of the tumbler drive wheel 401 and is in turn driven by gears attached to the motor, by any means known in the art. More This tumbler drive wheel gear 401 helps support the positioning of the tumbler wheel 401. The cross sectional view found in the next embodiment best shows how the tumbler drive wheel gear works 420.

On each of the pivot arms 413, 414, whether or not there're is one pivot axle 417, or more generally understood, on each side of the tumbler drive wheel gear is a spring anchor 421, 422 each of which is connected is a spring 423, 424. The distal ends of the spring are attached to mount axles, 451 found in body projections 452, 453. The springs 423 424 pull the tumbler drive wheel 401 up against the inside of the segmented tube, allowing for enough tension or friction such that the vehicle 400 can be propelled forward or backward. In another embodiment, there is a torsion spring 460 positioned connected to the body 427 just under one or both of the support arms 403, 404, with one end of (each of) the torsion spring or springs 427 pushing up on the support arm(s) 403, 404. It should be noted that there are numerous ways to those skilled in the art to put an upward tension on the pivot arms 413, 414.

As with the vehicle 300, in one embodiment there is an off/on switch 428. In another embodiment, there is a charge port 429. In yet another embodiment, the vehicle 400 can be powered by a battery within body 427.

In another embodiment, there is at least one wheel (or tire, used interchangeably here) 430, 431 on each side of the vehicle held by side axles 450, 451 positioned in body projections 452, 453. In another embodiment, there is at least one tire and in another embodiment two tires or wheels 433, 435 on the bottom and of the vehicle 400 and in another embodiment there are at least two tires 433, 435 in line on the bottom of the vehicle 400 and in yet another embodiment there are at least two upper guide wheels 434, 436 on top of the vehicle. In one embodiment, all wheels are in contact with the side of the inside of the segmented tubes to aid in the travel of the vehicle 400 through the tubes to prevent the vehicle 400 from loosely bouncing around, and thus allowing for a forward motion of the vehicle. The upper guide wheels keep the vehicle centered on the side track, as do the lower guide wheels, and the side (guide) wheels keep the vehicle centered and reduce friction around the corners.

In yet another embodiment, another tube vehicle 500 is similar to that as described infra except it has a torsion arm 501 with a torsion wheel 502 positioned at its proximal end, with the torsion wheel 502 held in place in by a pin or mini-axle 503. It is connected to the body 504 by being positioned between both halves 506, 507 of a connector joint 505. Alternatively, the torsion arm 501 can be held by any other means known in the state of the art.

As before, the tube vehicle 500 has a tumbler drive wheel 508 supported by support arms 509, 510. At the proximal end of the support arms 509, 510 are end caps 511, 512 which hold or are secured to the tumbler drive wheel 508, as described above. There are also two in-line upper guide wheels 513, 514 supported by axle arrangements. Just as the in the prior vehicle 400, described supra, these upper guide wheels 513, 514 and the lower guide wheels 515, 516 keep the car centered inside the track. Also as above, side guide wheels 517 and 518 keep the car centered and reduces friction around the corners.

The tumbler drive wheel 508 has, down its middle, geared teeth 520 which in turn mesh with the tumbler drive wheel gear 521. This tumbler drive wheel gear 521 in turn meshes with a second gear or spur gear 522 which in turn meshes with a pinion gear 523 attached to a sector gear 524 which is affixed or attached to a small electric motor 525. When the power switch 526 is moved to the on position, power from at least one battery flows from the batteries in a battery pack 527 to the electric motor 525 and the electric motor 525 in turn rotates by means of a spindle (not shown) or some other appropriate device the sector gear 524 and thus the pinion gear 523. The pinion gear 523 in turn rotates the second gear or spur gear 522. The spur gear 522 in turn rotates the tumbler drive wheel gear 521 which rotates the tumbler.

As with the embodiment of the toy vehicle 400 supra, the vehicle 500 has a charging dock 528 positioned as above in vehicle 400.

In one embodiment, the springs for keeping the tumbler drive wheel 508 raised up are the same. In another embodiment, the tumbler drive wheel 508 is supported by the tumbler drive wheel or spur gear 522. In either embodiment, a torsion spring 530 is located in the center of the pivot point connecting the torsion arm 501 to the body 504 with the torsion spring 530 positioned the hinge bar 531 holding the torsion arm 501 between both halves 506, 507 of the connector joint 505. This allows the torsion arm 501 to be permanently flexed against the inside wall of the tube track, and it further pushes the tumbler drive wheel 508 against the opposing inside wall of the tube track, thus aiding in traction and movement of the toy car.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents.

What is claimed is:

1. A toy segmented tube track kit, said kit comprising a) a segmented tube track comprising a plurality of identical hollow tube segments comprised of a resilient plastic material having an elastic memory, each said identical hollow tube segment comprising:

i) a first end, said first end comprising:

A) a receiving base comprising a plurality of cutouts; and

B) a locking top comprising a plurality of locking projections extending outward from the tube segment, said locking top positioned on top of and integrally molded with said receiving base;

ii) a second end identical to said first end, wherein said plurality of locking projections of said first end of a first hollow tube segment has the ability to lock into the plurality of cutouts to a second end of a second hollow tube segment in a repeating pattern to form the segmented tube track; and b) a toy vehicle having the ability to traverse though an inside of the segmented tube track.

2. The toy segmented tube track kit of claim 1, wherein said segmented tube track is transparent.

3. The toy segmented tube track kit of claim 1, wherein a circumference of receiving base is larger than the circumference of the locking top.

4. The toy segmented tube track kit of claim 1, wherein said toy vehicle comprises:

a) a car body said car body comprising;

i) a top side;

ii) a bottom side;

iii) a front side;

iv) a rear side;

v) a first side;

vi) a second side;

b) a motor within the car body;

c) a power source for the motor;

d) a drive wheel positioned above and in line longitudinally with the body;

e) an axle passing through said drive wheel;

f) an axle support connected at the distal end to the body and at the proximal end supporting the axle, said axle support being resiliently set to keep the drive wheel positioned above and against the inside of the segmented tube track;

g) two wheels positioned near the front side of the vehicle, said wheels positioned angularly near the bottom of vehicle wherein one wheel is positioned angularly on the first side of the vehicle and the second wheel is positioned angularly on the second side of the vehicle; and h) at least three wheels positioned at 120 angles to each other near the rear of the vehicle.

5. The toy segmented tube track kit of claim 1, wherein said segmented tubes are comprised of plastic.

6. The toy segmented tube track kit of claim 5, wherein said segmented tubes are opaque.

7. The toy segmented tube track kit of claim 5, wherein said segmented tubes are transparent.

8. The toy segmented tube track kit of claim 5, wherein said segmented tubes are translucent.

9. The toy segmented tube track kit of claim 5, wherein said segmented tubes have color.

* * * * *